US005265866A

United States Patent [19]

Greive

[11] Patent Number: 5,265,866

[45] Date of Patent: Nov. 30, 1993

[54] DEVICE FOR FEEDING AND FURTHER PROCESSING PRINTING MATERIAL IN SHEET-FED ROTARY PRINTING PRESSES

[75] Inventor: Martin Greive, Heidelberg/Ziegelhausen, Fed. Rep. of Germany

[73] Assignee: Heidelberger Druckmaschinen AG, Heidelberg, Fed. Rep. of Germany

[21] Appl. No.: 908,410

[22] Filed: Jul. 6, 1992

[30] Foreign Application Priority Data

Jul. 5, 1991 [DE] Fed. Rep. of Germany ..... 4122329

[51] Int. Cl.[5] ..... B65H 5/00

[52] U.S. Cl. ..... 271/225; 271/265; 271/273; 271/184

[58] Field of Search ..... 271/225, 265, 303, 184, 271/273, 10, 280; 101/118, 228, 279

[56] References Cited

U.S. PATENT DOCUMENTS 4,008,891 2/1977 Buys ..... 271/303 X
4,997,180 3/1991 Ishii et al. .

FOREIGN PATENT DOCUMENTS 1195155 12/1967 Fed. Rep. of Germany .
60-228352 11/1985 Japan ..... 271/225

*Primary Examiner*—David H. Bollinger
*Attorney, Agent, or Firm*—Herbert L. Lerner; Laurence A. Greenberg

[57] ABSTRACT

Device for feeding and further processing printing material in sheet-fed rotary printing presses includes a paper storage having a roller pair for conveying sheets out of the paper storage and a feed table movable relative to the paper storage. An optical detection device for detecting mis-fed sheets is disposed in the paper storage behind the roller pair and forward of the feed table. A transport roller and an intermediate gear wheel for driving the transport roller are mounted in the feed table. A device is disposed in the feed table for removing mis-fed sheets, and includes a shaft, at least two remover rollers rotatably mounted on the shaft, and an upper guide plate and a lower guide plate disposed adjacent the remover rollers. The guide plates, respectively, are formed with recesses and define therebetween a travel path for the sheets. The remover rollers dip into the recesses, and are cooperatively associated with the transport roller for removing mis-fed sheets.

7 Claims, 4 Drawing Sheets

DEVICE FOR FEEDING AND FURTHER PROCESSING PRINTING MATERIAL IN SHEET-FED ROTARY PRINTING PRESSES

The invention relates to a device for feeding and further processing printing material in sheet-fed rotary printing presses.

Japanese Published Non-Prosecuted Patent Application Hei 1-259947 discloses a paper feeding device of a sheet-fed printing press. A mis-fed sheet detection device is disposed in front of a transfer cylinder provided with gripping means. The mis-fed sheet detection device is located above and below a paper-transport plane. Mounted below the paper-transport plane are engageable transport rollers, which pass through intermediate spaces formed in a guide plate and can be brought into engagement with an outer cylindrical surface of the transfer cylinder. Swivelable strippers are mounted between the transfer cylinder and an impression cylinder, and have stripping tongues which dip into annularly extending slots formed on the transfer cylinder, peel off the mis-fed sheet from the circumference of the transfer cylinder and remove it in a storage container. This heretofore known paper feeding device is of relatively costly construction and requires considerable installation space. Moreover, the removal of a mis-fed sheet occurs only after the sheet has been accepted by a transfer drum.

It is an object of the invention of the instant application to convey mis-fed sheets detected during machine operation reliably and completely out of the plane in which the sheets are being fed.

With the foregoing and other objects in view, there is provided, in accordance with the invention, a device for feeding and further processing printing material in sheet-fed rotary printing presses, comprising a paper storage having a roller pair; a feed table movable relative to the paper storage; optical detection means disposed in the paper storage behind the roller pair; a transport roller and an intermediate gear wheel for driving the transport roller mounted in the feed table; means for removing mis-fed sheets including a shaft, at least two remover rollers rotatably mounted on the shaft, an upper guide plate and a lower guide plate, respectively, formed with recesses, the remover rollers dipping into the recesses; and the remover rollers and the transport roller being cooperatively associated with one another during the removal of mis-fed sheets.

An advantage which derives from the invention is that the mis-fed sheet continues to be transported, until it has been completely removed from the paper-feeding plane. The remover rollers press the leading edge of the mis-fed sheet under the front edge of the lower guide plate. The continuous action of the remover rollers on the mis-fed sheet permits a very large deflection of the mis-fed sheet, due to which the sheet can be rapidly removed from the paper-feeding plane. Consequently, stiffer, small-size printing materials may also be processed. In fact, it is possible to process paper sheets of any size or print, because there is always the assurance that the remover rollers will cooperate with the transport roller until the mis-fed sheet has cleared the paper-feeding plane.

In accordance with another feature of the invention, there are provided levers disposed in the feed table, the shaft wherein the remover rollers are rotatably mounted being held by the levers.

In accordance with a further feature of the invention, there is provided a magnet flanged to the feed table, the levers being swivelable about an axis of rotation by the magnet, and energy storage means mounted in the feed table for resetting the levers. Due to this feature of the invention, a very brief actuation time can be achieved. The construction of the levers with respect to inertial forces about the rotational axis, as well as the lever ratios with respect to one another, contribute towards reducing the actuation time.

In accordance with an alternative feature of the invention, there are provided means for actuating the levers by an application of pressure medium.

In accordance with an additional feature of the invention, there are provided at least one knurled screw for adjustably displacing one of the upper and lower guide plates towards the other. This permits the removal of the upper guide plate and a more precise adjustment of the gap between the upper guide plate and the lower guide plate. The upper guide plate, moreover, assists in effecting the sharp deflection of the mis-fed sheet when the latter is being removed.

In accordance with an added feature of the invention, an edge of the upper and lower guide plates defining the recesses, the edge facing away from the paper storage, extends diagonally to a plane of travel of a sheet being fed.

In accordance with a concomitant feature of the invention, there is provided a tape roller mounted in the feed table and operatively connected to the transport roller for driving the transport roller.

Other features which are considered as characteristic for the invention are set forth in the appended claims.

Although the invention is illustrated and described herein as embodied in a device for feeding and further processing printing material in sheet-fed rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
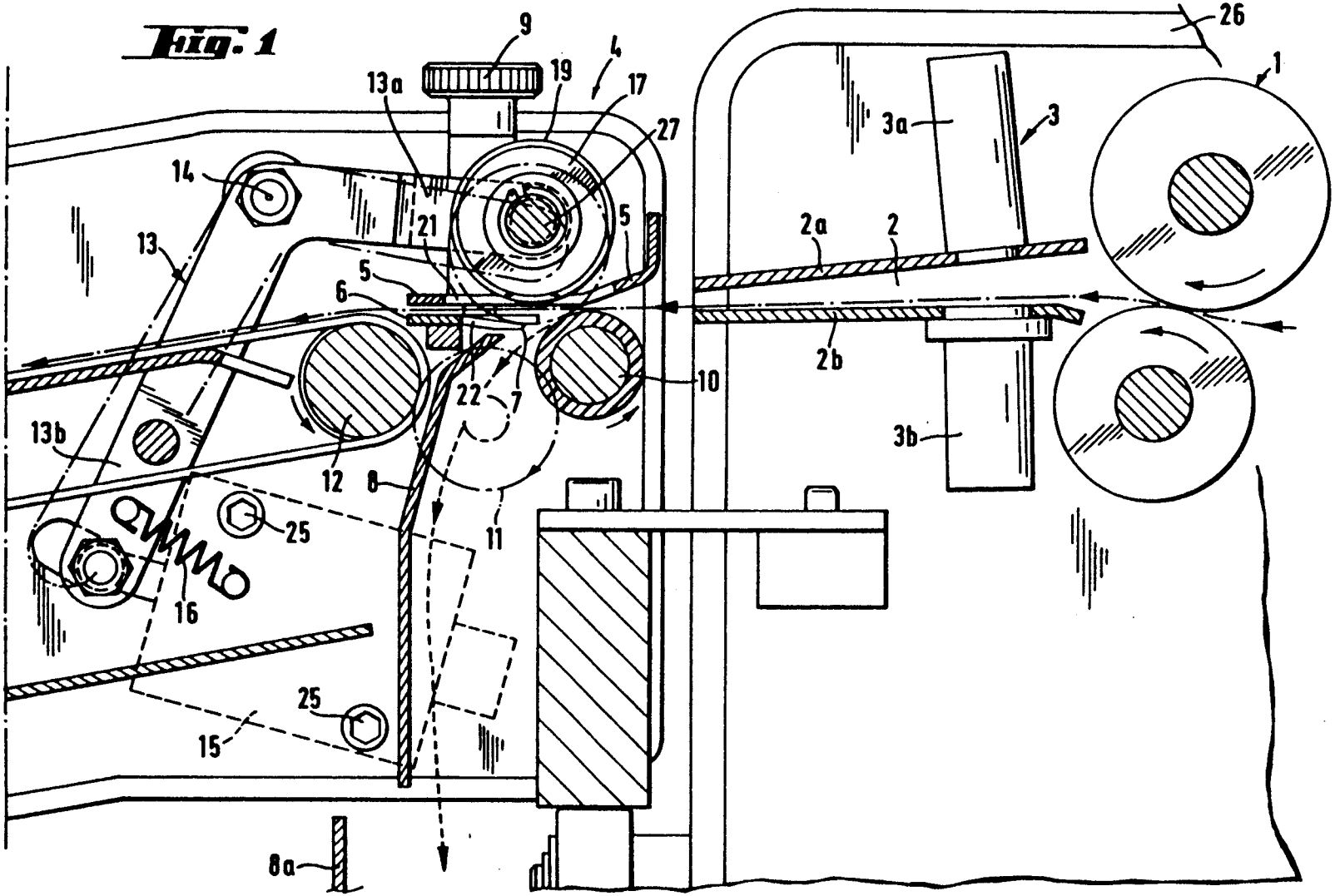
FIG. 1 is a longitudinal sectional view of a feed table and a paper storage.

Referring now to the drawing and, first, particularly to FIG. 1 thereof, there is shown therein, a sectional view of a feed table and paper storage, from which sheets are conveyed by a roller pair 1. Behind the roller pair 1, in the direction of feed of the sheets, there is provided an inlet funnel 2 which is formed of a top part 2*a* and a bottom part 2*b*. At the funnel 2, there is located an optional detection means 3 having a transmitter part 3*a* which is fastened onto the top part 2*a* of the funnel 2. A corresponding receiver part 3*b* of the optical detection means 3 is fastened to the bottom part 2*b* of the funnel 2.

After the paper has passed through the funnel 2, it enters a feed table 4. An inlet or entry region therefor is formed by an upper guide plate 5 and a driven transport roller 10. If the sheet is found to be in good condition, it passes through the gap formed between the upper guide plate 5 and a lower guide plate 6 form which it reaches a tape mechanism of the feed table 4, the tape mechanism being driven by a tape roller 12.

If the conveyed sheet is a mis-fed sheet, for example a double sheet, this fact is detected by the optical detection means 3. A magnet 15 is energized by the machine control and acts on levers 13 of double arm or bell-crank construction. The levers 13 are swiveled about a rotational axis 14. Sheet remover rollers 17, which are rotatably mounted on a shaft 27 at cranked ends 13*a* of the levers 13, are consequently brought into engagement with the circumference of a transport roller 10.

When the remover rollers 17 are in a downwardly swiveled position, as shown in phantom in FIG. 1, the leading edges of mis-fed sheets, as they leave the funnel 2 of a paper storage 26, are formed under the front edge 7 of the lower guide plate 6, so as to ensure further transport of the detected mis-fed sheet along a deflecting plate 8. Further transport of the detected mis-fed sheet is effected via the drive of the transport roller 10. This transport roller 10 is driven by an intermediate gear wheel 11 which is directly or force-lockingly connected to the tape roller 12 in the feed table 4. The downward swiveling of the shaft 27, which is mounted in the levers 13 and which bears the remover rollers 17, is enabled by recesses 21 and 22 provided in the guide plates 5 and 6. Through these recesses 21 and 22, the circumferential surfaces of the remover rollers 17 come into contact with the driven transport roller 10.

In order to assist in the deflection of the mis-fed sheets, the upper guide plate 5 additionally serves to guide the mis-fed sheets. The diameter of the remover rollers 17 can be greater than the diameter of the transport roller 10, in order to achieve greater coverage of the mis-fed sheet. The upper guide plate 5 is adjustably movable towards the lower guide plate 6 by means of knurled screws 9 located next to the levers 13. If required, the upper guide plate 5 can be removed. When using spacing elements, the gap width between the lower guide plate 6 and the upper guide plate 5 can be adapted to specific processing requirements by means of the knurled screws 9.

The achievement of short actuation times is further assisted by the configuration of the levers 13. The inertial forces of the cranked lever end 13*a* with respect to the rotational axis 14, and of the lever end 13*b* connected to the magnet 15 are more or less identical. The return of the lever 13 to its rest position, the engaged position of the remover rollers 17, as aforementioned, being represented in phantom, is accomplished by energy storage means 16, which may be in the form of a helical spring, torsion spring or similar element.

Figure 2:
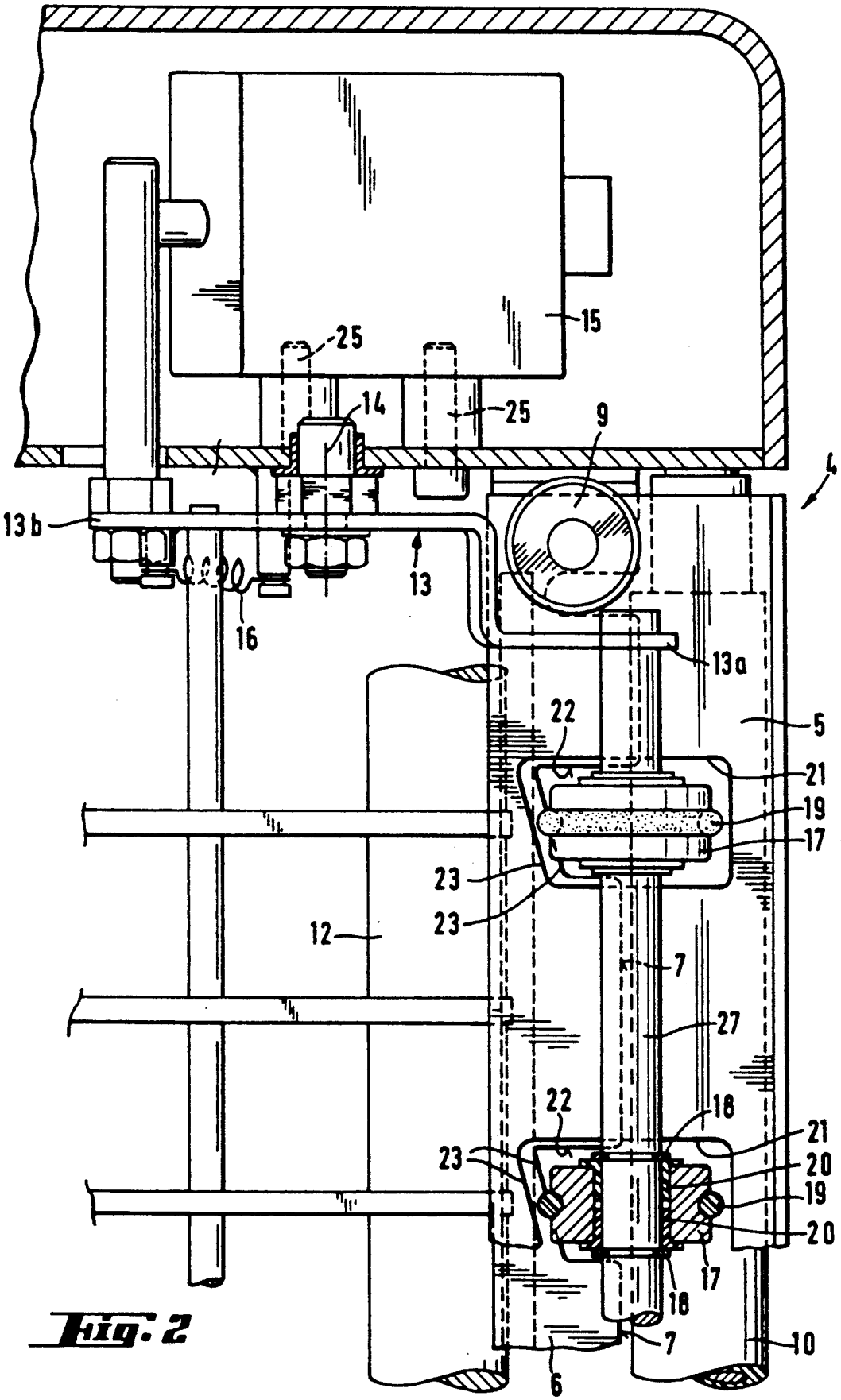
FIG. 2 is a fragmentary top-plan view of FIG. 1 showing the feed table thereof in further detail.

FIG. 2 is an enlarged top plan view of the upper guide plate 5. The magnet 15, fastened laterally to the feed table 4 by means of screws 25, moves the lever 13 which is fastened to the rotational axis 14. The shaft 27 is held in the levers 13, only one of which is illustrated in FIG. 1. On the shaft 27, in turn, remover rollers 17 are disposed in uniformly spaced relationship to one another. As shown in FIG. 2, the remover rollers 17 may be provided on the circumference thereof, with an elastic ring 19 having desirable friction properties. The remover rollers 17, respectively, run in two bearings 20, the positions of which are each fixed on the shaft 27 by a retaining ring 18 As can be seen in FIG. 2, a plurality of recesses 21 are provided in the upper guide plate 5. The recesses 21, respectively, are defined by an inclined edge or diagonal 23 which points towards the center of the machine. The lower guide plate 6, represented in FIG. 2 by broken items is likewise provided with recesses 22 which are defined by a diagonal edge. If the levers 13 are actuated, the remover rollers 17 and the rings 19, respectively, can come into contact with the mis-fed sheet to be removed by dipping into the recesses 21 and 22. The diagonal 23 has the positive characteristic of smoothing out a conveyed sheet which is wavy and of conveying it undamaged into the gap between the upper guide plate 5 and the lower guide plate 6.

Figure 3:
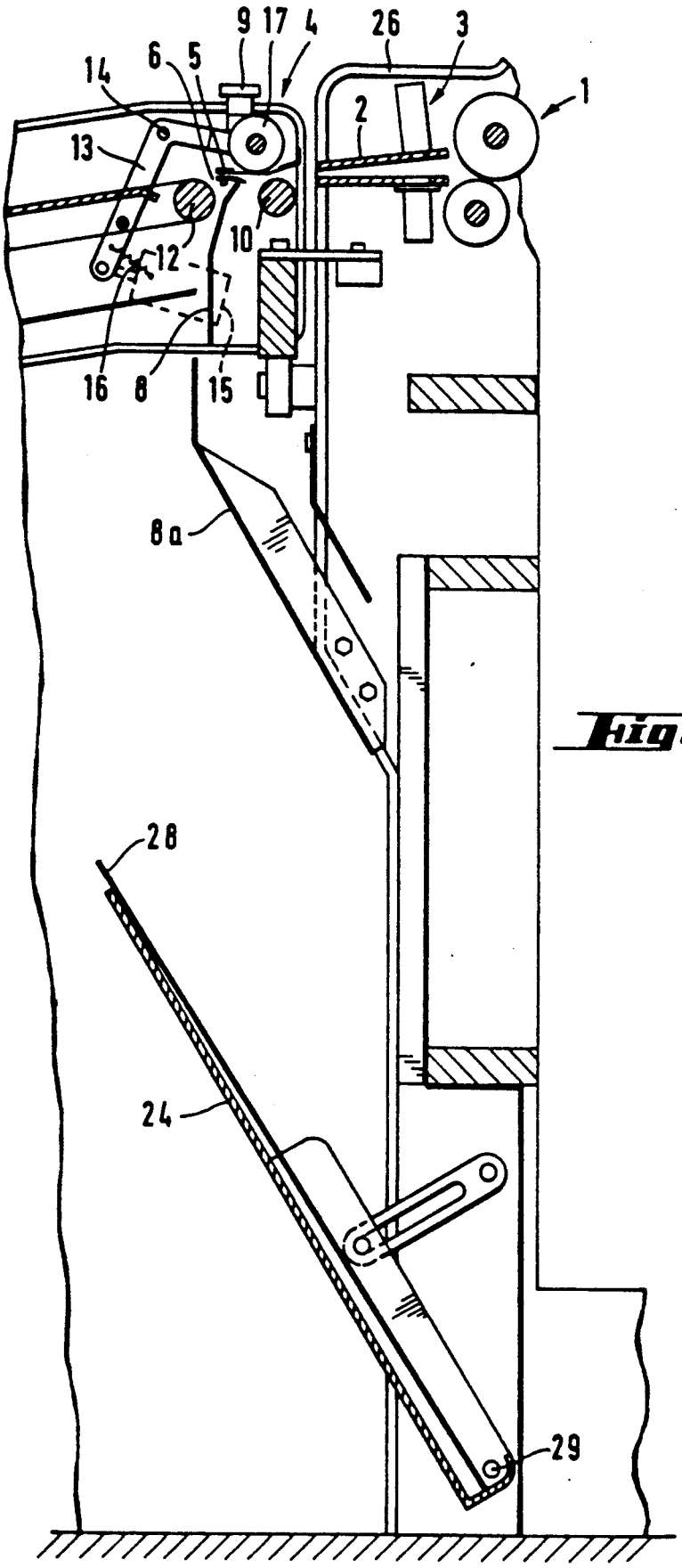
FIG. 3 is a reduced side elevational view, partly in section, of FIG. 1, equipped with a double-shaft pocket.

In FIG. 3 shows a side elevational view of the inventive device with a double-sheet pocket is illustrated. If a mis-fed sheet comes between the remover rollers 17 and the transport roller 10, it is forced under a front edge 7 (FIG. 1) of the guide plate 6, slides along a discharge plate 8, and enters a double-sheet pocket 24 via a sheet guide 8*a*. The double-sheet pocket 24 is turnably mounted on the paper storage 26 and permits removal of the mis-fed sheets 28.

Figure 4:
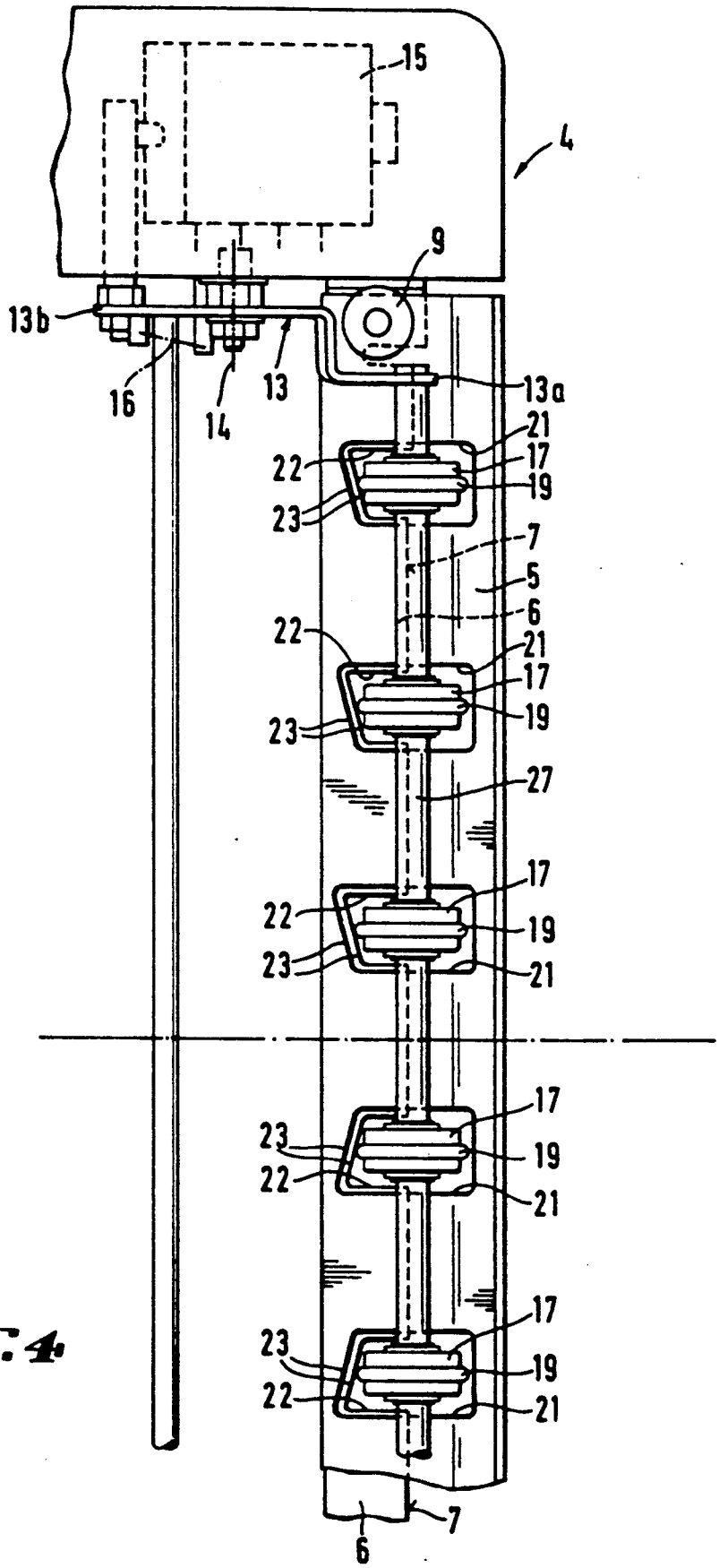
FIG. 4 is a reduced top-plan view of FIG. 2 showing a shaft thereof with a greater number of remover rollers.

FIG. 4 is a top-plan view of the shaft 27 on which there are mounted a large number of remover rollers 17. It can be seen that the diagonal edge defining the recesses 21 face towards a centerline marking the machine center, the diagonal edges 23 being disposed to the left-hand side of the centerline. In a mirror image thereof, the diagonal edges 23 defining the recesses 21 are oriented to the right-hand side of the centerline. The orientation of the diagonal edges 23 in this manner prevents the entry of the leading corner of the paper sheet, for a corresponding sheet size or format. Alternatively to actuating the levers 13 by means of an electromagnet 15, it is, of course, possible to employ a pneumatic cylinder in place thereof. It is also possible to install a mis-fed sheet detection means which operates mechanically instead of the optical detection means 3.

The foregoing is a description corresponding in substance to German Application P 41 22 329.2, dated Jul. 5, 1991, the International priority of which is being claimed for the instant application, and which is hereby made part of this application. Any material discrepancies between the foregoing specification and the aforementioned corresponding German application are to be resolved in favor of the latter.

I claim:

1. Device for feeding and further processing printing material in sheet-fed rotary printing presses, comprising a paper storage having a roller pair for conveying sheets out of said paper storage; a feed table movable relative to said paper storage; optical detection means for detecting mis-fed sheets disposed in said paper storage behind said roller pair and forward of said feed table; a transport roller and an intermediate gear wheel for driving said transport roller mounted in said feed table; means disposed in said feed table for removing mis-fed sheets, including a shaft, at least two remover rollers rotatably mounted on said shaft, and an upper guide plate and a lower guide plate disposed adjacent said remover rollers, said guide plates, respectively, being formed with recesses, said remover rollers dipping into said recesses and being cooperatively associated with said transport roller for removing mis-fed sheets.

2. Device according to claim 1, including levers disposed in said feed table, said shaft wherein said remover rollers are rotatably mounted being held by said levers.

3. Device according to claim 2, including a magnet flanged to said feed table, said levers being swivelable about an axis of rotation by said magnet, and energy storage means mounted in said feed table for resetting said levers.

4. Device according to claim 2, including means carried by said feed table for actuating said levers by an application of pressure medium.

5. Device according to claim 1, including at least one knurled screw mounted in said feed table for adjustable displacing one of said upper and lower guide plates toward the other.

6. Device according to claim 1, wherein an edge of said upper and lower guide plates defining said recesses, said edge facing away from the paper storage, extends diagonally to a plane of travel of a sheet being fed.

7. Device according to claim 1, including a tape roller mounted in said feed table and operatively connected to said transport roller for driving said transport roller.

* * * * *